US006683402B2

(12) United States Patent
Hens et al.

(10) Patent No.: US 6,683,402 B2
(45) Date of Patent: Jan. 27, 2004

(54) COLOR DISPLAY TUBE PROVIDED WITH A COLOR SELECTION ELECTRODE

(75) Inventors: Theodoor Christiaan Anna Hens, Eindhoven (NL); Wilhelmus Marinus Maria Van De Steen, Eindhoven (NL); Jean Winters, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 203 days.

(21) Appl. No.: 09/888,456

(22) Filed: Jun. 25, 2001

(65) Prior Publication Data

US 2001/0054864 A1 Dec. 27, 2001

(30) Foreign Application Priority Data

Jun. 27, 2000 (EP) ..... 00202248

(51) Int. Cl.[7] ..... H01J 29/80
(52) U.S. Cl. ..... 313/407; 313/402; 313/404
(58) Field of Search ..... 313/402, 404, 313/407, 405, 406, 408

(56) References Cited

U.S. PATENT DOCUMENTS 5,003,218 A 3/1991 Gijrath et al. ..... 313/406
5,898,259 A * 4/1999 Reyal ..... 313/407
5,982,085 A * 11/1999 Lakshmanan et al. ..... 313/407

* cited by examiner

*Primary Examiner*—Ashok Patel
*Assistant Examiner*—Sharlene Leurig

(57) ABSTRACT

In the manufacturing process of a color display tube (1), the display window (3) is assembled with the funnel shaped part (4) in a furnace by subjecting them to a heat treatment. This heat treatment can lead to deformation of the color selection electrode (12), because in color display tubes (1) with an invar shadow mask (13), the diaphragm parts (15) are made from invar as well, while the corner sections (16) are made from iron in order to obtain enough stiffness. The difference in expansion coefficient between invar and iron leads to shearing of the welds (22) that connect the diaphragm parts (15) to the corner section (16). To overcome this problem the invention proposes to provide the diaphragm parts (15) with slits (23) or impressions (24), which are arranged so that no stress occurs between the spot welds (22) when the color selection electrode (12) is heated.

13 Claims, 4 Drawing Sheets

COLOR DISPLAY TUBE PROVIDED WITH A COLOR SELECTION ELECTRODE

The invention relates to a colour display tube comprising a colour selection electrode having a frame comprising corner sections and diaphragm parts which are coupled to the corner sections.

The invention further relates to a colour selection electrode for use in such a colour display device and to a diaphragm part for use in said colour selection electrode.

A colour display tube as described in the opening paragraph is disclosed in U.S. Pat. No. 5,003,218. The colour display tube according to this specification is provided with a colour selection electrode having a frame consisting of four diaphragm parts and four corner sections, suspended in the corners of a display window.

The colour display tube described in U.S. Pat. No. 5,003,218 is provided with a colour selection electrode to ensure that electron beams coming from three electron guns, mounted in a neck portion of the tube, only excite electroluminescent material of one colour on the inner side of the display window. This colour selection is achieved by applying, for instance, a shadow mask in the tube. This mask comprises a large number of apertures, which are customarily arranged in either a slotted pattern or a dotted pattern. If the colour selection electrode is not stably positioned in the colour display tube, small deviations of its position will lead to a deterioration of the picture quality. When, for instance, the colour selection electrode is slightly deformed, the shadow effect of the colour selection electrode changes and consequentially, the electron beams do not hit the appropriate electroluminescent material on the display window. These registration errors cause discolouration of the display tube that leads to a deterioration of the quality of the picture on the colour display tube.

The colour display tube of the prior art has the disadvantage that the shadow mask, especially when this shadow mask is made from invar—which is a nickel-iron alloy—material, shows deformations during the manufacture of the colour display tube. In most high performance colour display tubes, the shadow mask as well the diaphragm parts are made of invar material, because the thermal expansion coefficient of invar is very low, resulting in a good doming performance. The corner sections of the colour selection electrode are normally made of iron because this offers an optimal stiffness of the colour selection electrode. After screen processing, i.e. the process wherein the black matrix and phosphor layers are applied to the inner side of the display window to form the screen, the display window is assembled with the funnel shaped part in a furnace. The high temperatures in this furnace cause permanent deformations in the frame of the colour selection electrode, due to the differences in expansion between the diaphragm parts and the corner sections.

It is an object of the invention to provide a colour display tube having an improved colour selection electrode with respect to the type described in the opening paragraph, which strongly reduces the registration errors on the display window.

According to the present invention, this object is achieved by means of a colour display tube which is characterized in that the diaphragm parts are provided with coupling means that increase the thermal stability of the frame.

The invention is based on the insight that the registration errors are diminished when the positional stability of the colour selection electrode with respect to the display window is increased during the heat treatment in the furnace where the display window and the funnel shaped part are assembled. This can be realized by providing the frame with coupling means for interconnecting the diaphragm parts and the corner sections in such a way that the differences in thermal expansion between the invar diaphragm parts and the iron corner section do not lead to a deformation of the frame of the colour selection electrode. In this way, the thermal stability of the frame is improved.

A preferred embodiment of the colour display tube according to the present invention is characterized in that the coupling means comprise an area for welding the diaphragm part to the corner section, which area further comprises slits.

When the area of the diaphragm part at which it is welded to the corner section is provided with slits, the diaphragm parts will not deform when the corner sections show a much larger expansion, because the slits in between different welding points ensure that the welds cannot shear.

In another embodiment, the coupling means comprise an area for welding the diaphragm part to the corner section, which area further comprises impressions.

This embodiment also prevents shearing of the welds between the diaphragm parts and the corner section. This can be attributed to the fact that the impression is stretched when the corner section expands more than the diaphragm part.

In a further embodiment, the diaphragm parts are welded to the corner sections by means of a plurality of spot welds.

The use of spot welds further increases the dimensional stability of the frame of the colour selection electrode, because the welds are small enough to prevent that stress occurs between the diaphragm part and the corner section at the location of the weld.

Yet another embodiment is characterized in that the diaphragm parts further comprise mathematical lines connecting the two spot welds of any pair, which mathematical lines are intersected by at least one slit or impression.

This embodiment has the advantage that in between each pair of welds a slit or impression is present. As a result, the differences in thermal expansion can be compensated for between all the welds. As a result, the diaphragm part will not be deformed and the positional stability of the frame is improved.

The invention also relates to the colour selection electrodes and the diaphragm parts used in a colour display tube according to the invention.

These and other aspects of the invention will be apparent from and elucidated by way of non-limitative examples with reference to the drawings and the embodiments described hereinafter.

Figure 1:
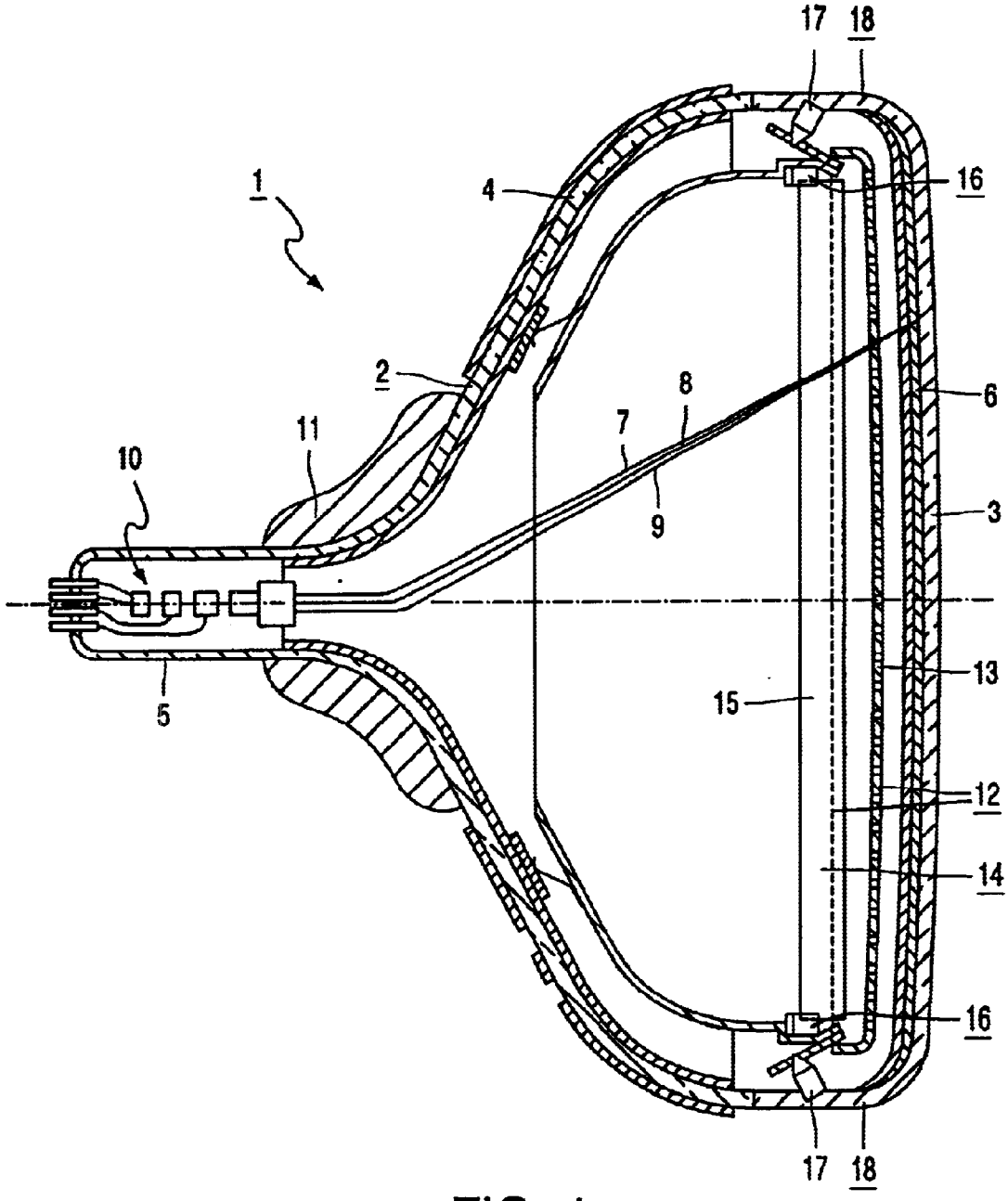
FIG. 1 is a sectional view of a colour display tube according to the invention.

The colour display tube 1 shown in FIG. 1 comprises an evacuated glass envelope 2 with a display window 3, a funnel shaped part 4 and a neck 5. On the inner side of the display window 3 a screen 6 having a pattern of for example lines or dots of phosphors luminescing in different colours (e.g. red, green and blue) may be arranged. The phosphor pattern is excited by the three electron beams 7, 8 and 9 that are generated by the electron gun 10. On their way to the screen, the electron beams 7, 8 and 9 are deflected by the deflection unit 11, ensuring that the electron beams 7, 8 and 9 systematically scan the screen 6.

Before the electrons hit the screen 6, they pass through a colour selection electrode 12. This colour selection electrode 12 comprises a shadow mask 13, which is the real colour selection part: it intersects the electron beams so that the electrons only hit the phosphor of the appropriate colour. The shadow mask 13 may be a mask having circular or elongate apertures, or a wire mask. Further, the colour selection electrode 12 comprises the frame 14 for supporting the mask. Parts that can be distinguished in the frame 14 are, amongst others, the corner sections 16 and the diaphragm parts 15, interconnecting the corner sections 16.

By means of the suspension elements 20 which are coupled to the corner sections 16, the colour selection electrode 12 is suspended from the display window 3 by using supporting elements 17, which are secured in the upright edge of the corner areas 18 of the display window 3. This way of suspending the colour selection electrode 12 in a colour display tube 1 will further be referred to as corner suspension.

Figure 2:
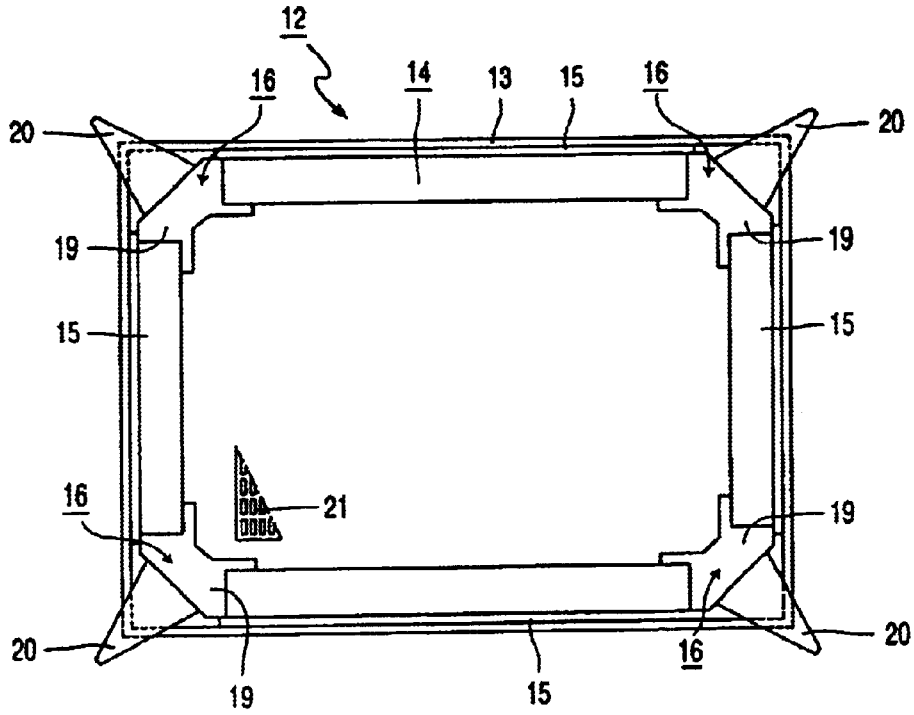
FIG. 2 is an elevational view of a colour selection electrode to be mounted in the tube of FIG. 1.

In FIG. 2 an elevational view of a colour selection electrode 12 is given. The corner sections 16 in this Figure comprise two major portions, a rigid portion 19 for interconnecting the diaphragm parts 15 and a suspension element 20 for suspending the colour selection electrode 12 from the display window 3. The shadow mask 13 is coupled to the diaphragm parts 15. The section 21 of the mask as indicated in FIG. 2 serves only as an example.

Figure 3:
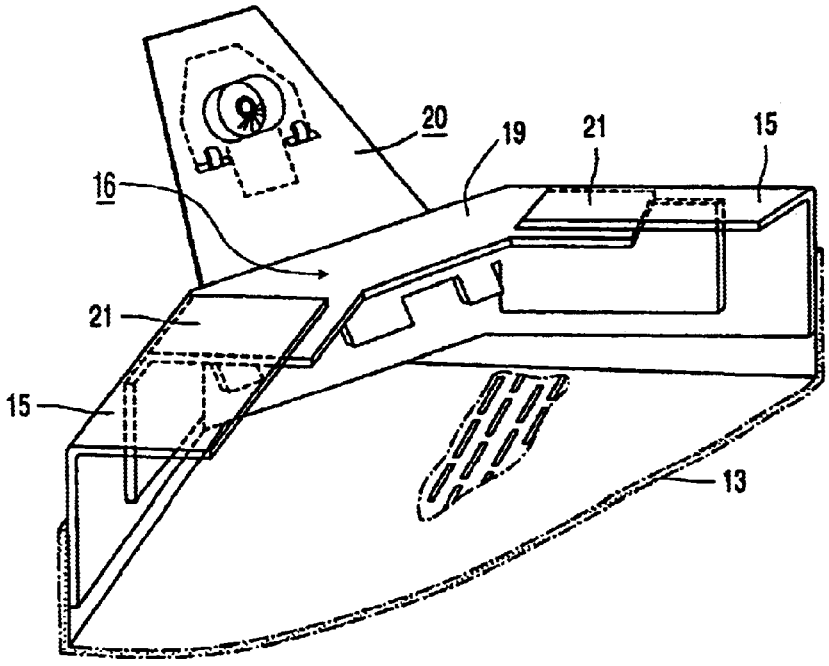
FIG. 3 is a perspective view of the corner section of the colour selection electrode.

FIG. 3 gives a perspective view of the corner section 16, which comprises a rigid portion 19 and a suspension element 20. The rigid portion 19 is normally made from iron in order to obtain enough stiffness, which is necessary for giving the colour selection electrode 12 its mechanical stability. In colour display tubes 1 with an invar shadow mask 13, or with a shadow mask made of another low-expansion steel, the diaphragm parts 15 are made from the same material to improve the doming performance of the colour display tube. The overlapping areas 21 between the rigid portion 19 of the corner section 16 and the diaphragm parts 15 are used for interconnecting both parts.

Figure 4A:
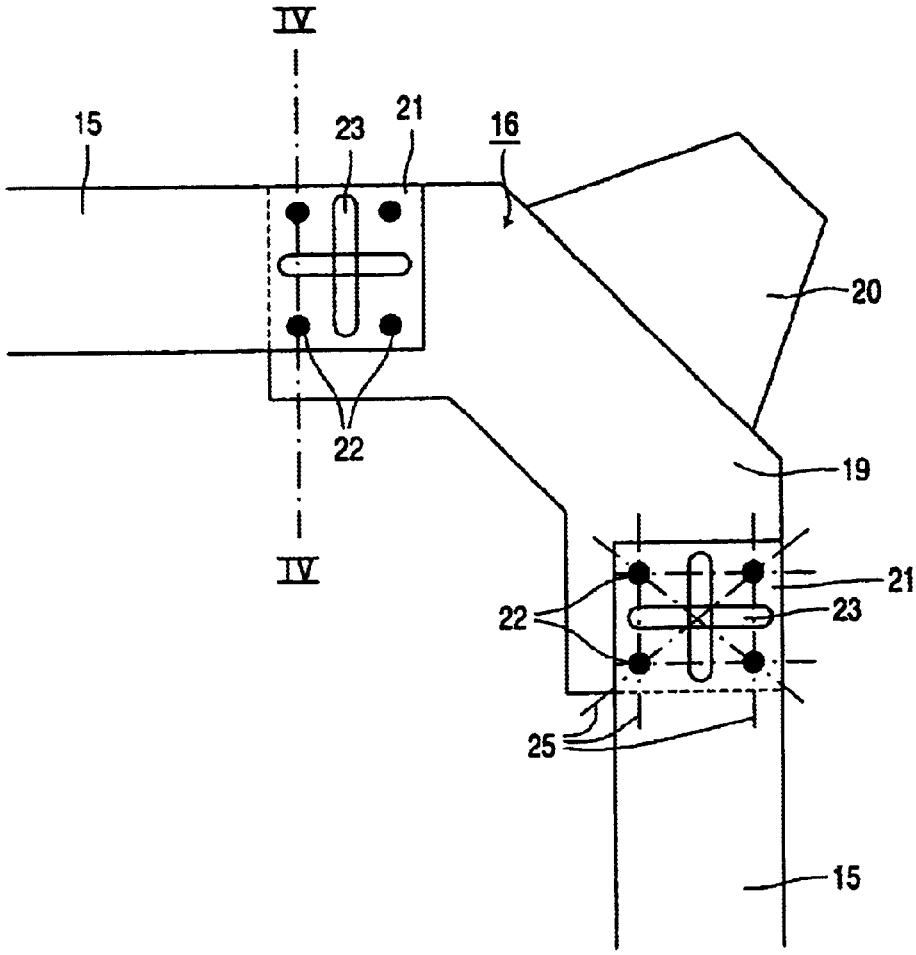
FIGS. 4A and 4B are, respectively, an elevational view and a cross-sectional view of the assembly of a corner section and diaphragm parts with slits according to the invention.
Figure 4B:
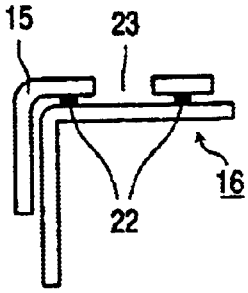

FIGS. 4A and 4B give a part of the frame 14 comprising a corner section 16 and two—partly shown—diaphragm parts 15. The suspension means 20 are depicted only schematically. The areas 21 indicate where the diaphragm parts 15 and the rigid portion 19 of the corner section 16 overlap. In this example, the connection between diaphragm part 15 and corner section 16 is made by four spot welds 22. The diaphragm parts 15 are in this example provided with slits 23 which have been cut crosswise in the area 21. By virtue of this construction, a slit 23 is formed crosswise in between any pair of spot welds 22; this is indicated by the mathematical lines 25 connecting any two spot welds 22, and each mathematical line is intersected by a slit 23. A cross-section of this embodiment is given in FIG. 4B. When the colour selection electrode is heated to a temperature of about 450° C. which is about the temperature in the furnace for assembling the display window 3 and the funnel shaped part 4—the iron corner section 16 will expand more than the invar diaphragm part 15. In the absence of the slits 23, stress occurs between the welds 22 leading to shearing of these welds. Consequently, the diaphragm parts 15, which are thinner than the corner sections 16, are deformed. The slits which cross each interconnecting line between two spot welds prevent this shearing of the spot welds 22, and the diaphragm parts 15 are not deformed.

Figure 5A:
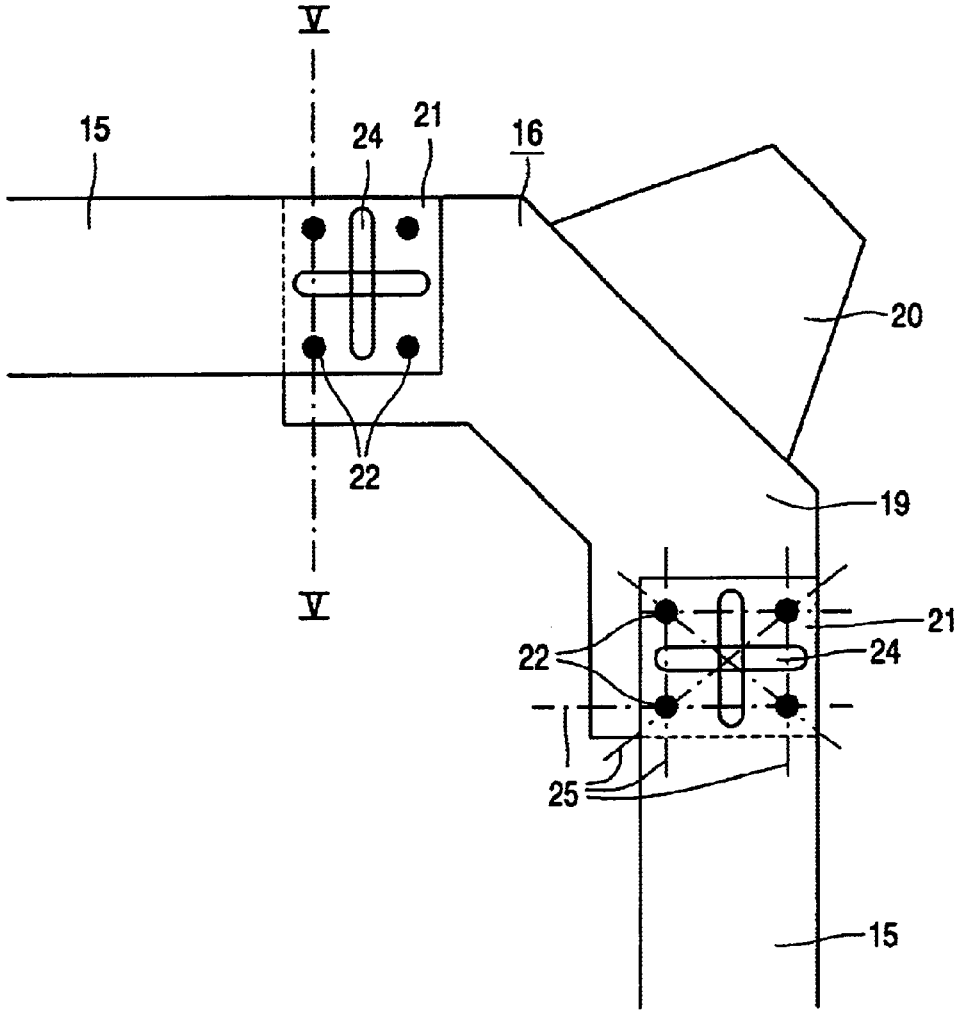
FIGS. 5A and 5B are, respectively, an elevational view and a cross-sectionial view of the assembly of a corner section and diaphragm parts with impressions according to the invention.
Figure 5B:
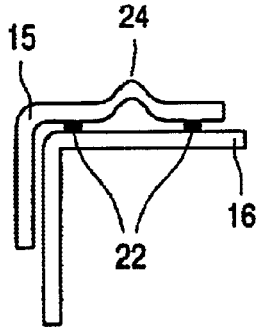

An alternative embodiment is given in the FIGS. 5A and 5B. Instead of slits 23, the diaphragm parts are provided with impressions 24. By virtue of these impressions 24, the diaphragm parts 15 contain, between any two spot welds 22, enough material that is stretched when the corner section 16 expands more than the diaphragm part 15, the effect being the same: preventing shearing of spot welds 22.

It will be clear to a person skilled in the art that this invention is not limited to the examples given here. Alternatives may be considered, such as combinations of slits and impressions, rows of small round apertures, impressions with different profiles etc.

Summarizing, in the manufacturing process of a colour display tube 1, the display window 3 is assembled with the funnel shaped part 4 in a furnace by subjecting them to a heat treatment. This heat treatment can lead to deformation of the colour selection electrode 12, because in colour display tubes 1 with an invar shadow mask 13, the diaphragm parts 15 are made from invar as well, while the corner sections 16 are made from iron in order to obtain enough stiffness. The difference in expansion coefficient between invar and iron leads to shearing of the welds 22 that connect the diaphragm parts 15 to the corner section 16. To overcome this problem the invention proposes to provide the diaphragm parts 15 with slits 23 or impressions 24, which are arranged so that no stress occurs between the spot welds 22 when the colour selection electrode 12 is heated.

What is claimed is:

1. A color selection electrode, comprising:

a plurality of corner sections, each having a rigid portion and a suspension element;

a plurality of diaphragm parts that link said plurality of corner sections together to form a frame, wherein at least one diaphragm part of said plurality of diaphragm parts has an end section that is spot welded at least twice to an associated corner section of said plurality of corner sections; and a shadow mask connected to said plurality of elongated diaphragm parts;

wherein said end section includes a stress relief feature between said spot welds.

2. A color selection electrode according to claim 1, wherein said stress relief feature is a slit disposed such that a line between said spot welds passes through said slit.

3. A color selection electrode according to claim 1, wherein said end section is spot welded in at least four places to said associated corner section, and wherein said stress relief feature includes a plurality of slits disposed such that a line between any two of said spot welds passes through at least one slit.

4. A color selection electrode according to claim 1, wherein said stress relief feature is an impression disposed such that a line between said spot welds passes through said impression.

5. A color selection electrode according to claim 1, wherein said end section is spot welded in at least four places to said associated corner section, and wherein said stress relief feature includes a plurality of impressions disposed such that a line between any two of said spot welds passes through at least one impression.

6. A color picture tube comprising:

an evacuated glass envelope having a display window, a funnel shaped part, a neck, and a plurality of supporting elements;

an electron gun that is at least partially disposed within said neck; and a color selection electrode that includes:

a plurality of corner sections, each having a rigid portion and a suspension element;

a plurality of diaphragm parts that link said plurality of corner sections together to form a frame, wherein at least one diaphragm part of said plurality of diaphragm parts has an end section that is spot welded at least twice to an associated corner section of said plurality of corner sections; and a shadow mask connected to said plurality of elongated diaphragm parts;

wherein said frame is dimensioned such that the suspension elements of said plurality of corner sections attach to said plurality of supporting elements; and wherein said end section includes a stress relief feature between said spot welds.

7. A color picture tube according to claim 6, wherein said stress relief feature is a slit disposed such that a line between said spot welds passes through said slit.

8. A color picture tube according to claim 6, wherein said end section is spot welded in at least four places to said associated corner section, and wherein said stress relief feature includes a plurality of slits disposed such that a line between any two of said spot welds passes through at least one slit.

9. A color picture tube according to claim 6, wherein said stress relief feature is an impression disposed such that a line between said spot welds passes through said impression.

10. A color picture tube according to claim 6, wherein said end section is spot welded in at least four places to said associated corner section, and wherein said stress relief feature includes a plurality of impressions disposed such that a line between any two of said spot welds passes through at least one impression.

11. A color picture tube according to claim 6, wherein said end section and said associated corner section are comprised of metals having different coefficients of thermal expansion.

12. A color picture tube according to claim 11, wherein said stress relief feature provides stress relief against thermally induced stress.

13. A color picture tube according to claim 11, wherein said end section and shadow mask having substantially equal coefficients of thermal expansion.

* * * * *